US006226845B1

(12) United States Patent
Fink

(10) Patent No.: US 6,226,845 B1
(45) Date of Patent: May 8, 2001

(54) BUCKLE CLIP

(76) Inventor: Matthew L. Fink, 16 Arcadia Ave., Dedham, MA (US) 02026

( * ) Notice: Subject to any disclaimer, the term of this patent is extended or adjusted under 35 U.S.C. 154(b) by 0 days.

(21) Appl. No.: 09/405,762

(22) Filed: Sep. 27, 1999

(51) Int. Cl.[7] ..... A44B 11/25

(52) U.S. Cl. ..... 24/668; 24/322.1; 24/666; 24/678

(58) Field of Search ..... 24/668, 666, 678, 24/322.1

(56) References Cited

U.S. PATENT DOCUMENTS

| | | | | |
|---|---|---|---|---|
| D. 396,827 | | 8/1998 | Luk . | |
| 1,346,911 | * | 7/1920 | Peterson | 24/668 |
| 1,820,450 | * | 8/1931 | Fenton | 24/668 |
| 1,824,547 | * | 9/1931 | Hodge | 24/668 |
| 1,831,804 | * | 11/1931 | Domkee | 24/668 |
| 1,885,336 | * | 11/1932 | Domkee | 24/668 |
| 2,146,496 | * | 2/1939 | Anderson | 24/668 |
| 4,935,997 | * | 6/1990 | Hirsch | 24/668 |
| 5,005,269 | | 4/1991 | Hirsch . | |
| 5,706,561 | | 1/1998 | Kipperman . | |

* cited by examiner

*Primary Examiner*—Victor N. Sakran

(74) *Attorney, Agent, or Firm*—Joseph R. Birkner

(57) ABSTRACT

The present invention relates to a buckle clip for receiving and for removably retaining a fastener such as a button having a shank for a garment such as the type used on suspenders, overall straps, jeans and other garments and structures in need of support. In a preferred embodiment, the buckle clip is fabricated from a continuously formed resilient wire to define a loop. The loop has a bight portion for suspension from a strap, a pair of arms for receiving a fastener such as a button having a shank and an open portion for receiving and for removably retaining the button. The bight portion has a pair of feet portions with a first end and with a second end which are resiliently separable and normally spring biased toward each other to engage the shank of the button. The pair of feet portions have a groove and a first pair and a second pair of contact surfaces. The loop provides resilient movement of the open portion for engaging and for disengaging the button. An encasement, slideably attachable to the bight portion of the loop, completely envelopes the ends of the pair of feet portions. The encasement has side passageways through which a part of the pair of feet portions extend, within the encasement, to engage and to release the fastener as they separate when the pair of feet portions resiliently move laterally. The encasement has a pair of stop walls integrally formed thereon which cooperate with the groove and with each pair of contact surfaces for limiting the resilient lateral movement of the pair of feet portions to prevent over extension of the loop.

20 Claims, 3 Drawing Sheets

BUCKLE CLIP

FIELD OF THE INVENTION

This invention relates generally to spring clips. More particularly, the present invention relates to a resilient buckle clip for receiving and for engaging a fastener such as a button having a shank to define a fastening and strap supporting device.

BACKGROUND OF THE INVENTION

It was recognized by the present inventor that there is a need for an improved spring clip, particularly a garment buckle clip of the type used to support straps on overalls, jeans, trousers or suspenders.

One type of known clips are single piece retention clips. The one piece clips were forms made into a one piece loop of a welded wire or from stamped metal which had relatively little flexibility. These clips are urged over a button shank and retained a garment in place by gravity since there was no spring tension to hold a clip onto the shank of a button; however, these one piece clips were prone to separating from the garment. Furthermore, pieces which are welded together are subject to breakage due to fatigue after repeated use and after frequent laundering.

U.S. Pat. No. 5,706,561 to Kipperman shows an improved spring clip garment loop for engaging and disengaging a button. In a preferred embodiment, the loop is manufactured from a single piece of wire which provides for resilient movement of a button receiving portion by means of an interlocked sliding horizontal strap bar. The exposed interlocking ends of the sliding horizontal bar can snag and abrade the garment and can grasp and collect pieces of dirt and lint from the surrounding garment area which will become entrapped in the interlocking ends and thereby interfere with the operation of the spring clip.

U.S. Design Pat. No. 396,827 to Luk shows an ornamental design for a buckle having a loop and a pair of round portions of the loop exposed through apertures formed in a cylindrical housing.

Another known method of making a spring clip is shown in U.S. Pat. No. 5,005,269 to Hirsch which discloses a resilient spring clip shoulder strap loop with a U-shaped resilient wire loop that has a saddle-shaped exposed encasement attached to a non-circular button receiving and button securing portion. The encasement has a closed pocket and an open notch for the button shank. One disadvantage of the spring clip is that the rigid assembly of the saddle shaped encasement to the non-circular button portion of the loop may be cumbersome and highly susceptible to weak assembly due to poor mating of parts which could result in the unintentional formation of burrs or sharp edges on the encasement. Furthermore, the exposed encasement could become distorted during laundering or from repeated use which could severely impair operation. The encasement may be therefore subjected to premature and unwanted loss particularly when a child plays with it and pries it loose or sucks or bites on it thereby risking the possibility of swallowing it or risking the possibility of being cut by the external burrs or sharp edges. Still another problem of the spring clip is that the open notched section, due to its upward facing, gravity favorable, orientation, serves as a conduit through which dirt and lint could enter and collect in the pocket of the encasement which will eventually jam and interfere with operation.

Accordingly, it becomes clear that there is a great need for a buckle clip for receiving and for engaging a fastener such as a button having a shank to define a fastening and strap supporting device which overcomes the disadvantages of the prior art clips. Such a buckle clip should be one that is easy to use, positively engages and disengages a button and is economically manufactured.

SUMMARY OF THE INVENTION

It is therefore an object of this invention to provide a buckle clip for receiving and for engaging a fastener such as a button having a shank to define a fastening and strap supporting device which avoids the aforementioned problems of prior art devices.

It is therefore an object of the present invention to provide an improved buckle clip which provides resilient lateral movement of a button receiving and of a button retaining portion for positively engaging and disengaging the button.

It is a further object of this invention to provide an improved buckle clip which may be manufactured from a single piece of continuously formed resilient wire.

It is also an object of this invention to provide a buckle clip with a loop that has a bight portion for suspension from a strap, a pair of arms for receiving a fastener such as a button having a shank and an open portion for receiving and removably retaining the button.

Another object of this invention to provide a buckle clip that has a bight portion having a first end and a second end and a pair of feet portions.

It is also an object of this invention to provide a buckle clip that has a pair of feet portions having a groove and a first pair of contact surfaces and a second pair of contact surfaces thereon disposed in close proximity to the first end and to the second end of the bight portion near the midpoint of the bight portion and the pair of feet portions of said bight portion being resiliently separable and normally spring biased toward each other to engage the shank of the button.

Yet another object of the present invention is to provide a buckle clip which has an encasement for completely enveloping the first end and the second end of the pair of feet portions which is slideably attachable to the bight portion of the loop.

Still another object of the present invention is to provide a buckle clip which has an encasement having side passageways through which a part of the pair of feet portions extend, within the encasement, to engage and to release the fastener as they separate when the pair of feet portions resiliently move laterally.

It is also an object of this invention to provide a buckle clip that has an encasement having a pair of stop walls integrally formed within a front wall of the encasement by punching and by inwardly bending a portion of the front wall thereby resulting in the creation of a pair of apertures in the front wall and the stop walls being disposed interiorly of the encasement.

It is also an object of this invention to provide a buckle clip that has an encasement with the stop walls cooperating with the groove of the pair of feet portions and with the first pair of contact surfaces and with the second pair of contact surfaces for limiting the resilient lateral movement of the pair of feet portions to prevent over extension of the loop.

It is still a further object of this invention to provide a buckle clip that has an encasement being developed from a C-shaped member formed from an elongated substantially planar sheet of rigid material.

It is a further object of this invention to provide a buckle clip that is simple in design, simple to manufacture, low in cost and easy to use.

This invention results from the realization that there is a great need for an improved spring clip, particularly a buckle clip of the type used to support straps on garments such as on overalls, jeans, trousers or suspenders. The resulting invention provides a user the capability of conveniently and securely engaging and disengaging a fastener such as a button to the garment.

The above and the other objects are achieved in accordance with the present invention, which, according to a first aspect, provides a buckle clip comprising a loop. The loop may be continuously formed from a resilient wire, and the loop having a bight portion for suspension from a strap, a pair of arms for receiving a fastener such as a button having a shank and an open portion for receiving and for removably retaining the button. The bight portion has a first end and a second end and a pair of feet portions. The pair of feet portions have a groove thereon disposed in close proximity to the first end and to the second end of the bight portion near the midpoint of the bight portion. The pair of feet portions have a first pair of contact surfaces and a second pair of contact surfaces. The pair of feet portions of the bight portion are resiliently separable and normally spring biased toward each other to engage the shank of the button. An encasement is slideably attachable to the bight portion of the loop with the encasement completely enveloping the first end and the second end of the pair of feet portions. The encasement having side passageways through which a part of the pair of feet portions extend as they separate when the pair of feet portions resiliently move laterally. The encasement has a pair of stop walls integrally formed thereon. The stop walls cooperate with the groove and with the first pair of contact surfaces and with the second pair of contact surfaces of the pair of feet portions for limiting the resilient lateral movement of the pair of feet portions to prevent over extension of the loop.

The second aspect is a special case of the first aspect of this invention with additional features. According to a second aspect of the invention, a buckle clip with a loop continuously formed from a single piece of resilient wire, having a bight portion for suspension from a strap, a pair of arms for receiving a fastener such as a button having a shank and an open portion for receiving and for removably retaining the button; and an encasement of a one piece construction in the form of an elongated enveloping shape having a square cross section being dimensioned to allow sufficient resilient lateral movement of the resilient wire loop for receiving and for engaging the shank of the button, for removably retaining the button and for translating the resilient lateral movement of the open portion to said pair of feet portions of the bight portion; the encasement is centrally disposed on the bight portion; the encasement having a pair of stop walls integrally formed within a front wall of the encasement by punching and by inwardly bending a part of the front wall such that the pair of stop walls are disposed interiorly of the encasement is disclosed.

According to a third aspect of the invention, a method for manufacturing a buckle clip is disclosed comprising the steps of providing a resilient wire and continuously forming a loop from the resilient wire which has a bight portion with a first end and a second end and a pair of feet portions for suspension from a strap, a pair of arms for receiving a fastener such as a button having a shank and an open portion for receiving and for removably retaining the button. Creating a groove thereon the feet portions disposed in close proximity to the first end and to the second end of the bight portion near the midpoint of the bight portion resulting in the creation of a first pair of contact surfaces and a second pair of contact surfaces. Providing an elongated substantially planar sheet of rigid material and developing a C-shaped member having a pair of stop walls integrally thereon, a top wall, a bottom wall, a front wall and two wall portions, an upper wall and a lower wall from the elongated substantially planar sheet of rigid material. Slideably attaching the C-shaped member to the bight portion of the loop by aligning the pair of stop walls of the C-shaped member with the groove of the pair of feet portions of the bight portion of the loop and forming an encasement having a back wall being defined when the upper wall and the lower wall portions of the C-shaped member are joined in an abutting relationship by crimping the C-shaped member to the bight portion of the loop such that the encasement completely envelopes a part of the bight portion and the encasement having side passageways through which a part of the pair of feet portions of the bight portion extend as they separate during resilient lateral motion such that the lateral motion is limited by the stop walls to prevent over extension of the loop.

DETAILED DESCRIPTION OF PREFERRED EMBODIMENTS

Figure 1:
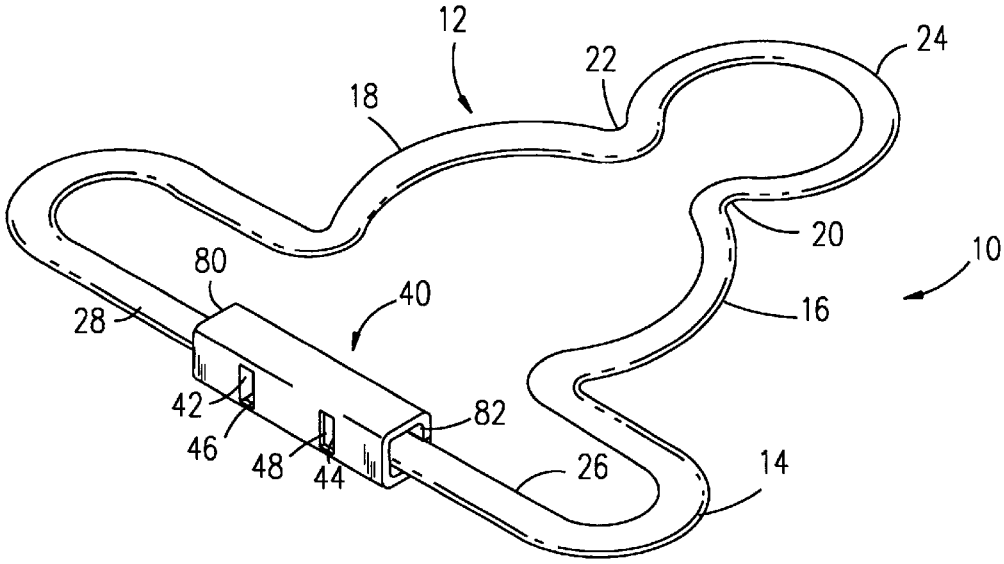
FIG. 1 a perspective view of a preferred embodiment of a buckle clip of the instant invention.

Looking more particularly to the drawings, FIG. 1 depicts a perspective view of a preferred embodiment of the buckle clip, which is indicated generally at 10, according to a preferred embodiment of the present invention. Buckle clip 10, essentially comprises a loop 12 continuously formed from a resilient wire, having a bight portion 14 for suspension from a strap, a pair of arms 16, 18 for receiving a fastener 50, shown in FIG. 7 and in FIG. 8, such as a button 52 having a shank 54, an open portion 24 for receiving and for removably retaining the button 52 and an encasement 40 slideably disposed on the bight portion 14. The encasement 40 has stop walls 42, 44, apertures 46, 48 and side passageways 80, 82 through which a portion of a pair of feet portions 26, 28 move, within the encasement, to engage and to release the fastener 50 as they separate when the pair of feet portions 26, 28 restrictively, resiliently, extend laterally. The open portion 24 has a neck portion 20, 22, through which the fastener 50 passes enroute to being received and being removably retained in the open portion 24.

Figure 2:
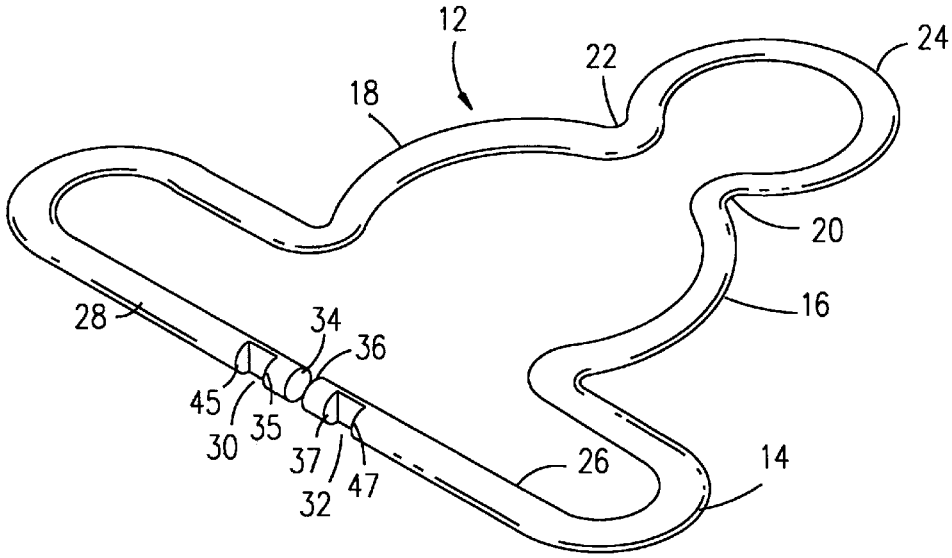
FIG. 2 is a perspective view of a preferred embodiment of the buckle clip of FIG. 1 showing a loop with grooves on feet portions in close proximity to the ends of a bight portion near the midpoint of the bight portion.

As shown in FIG. 2, the bight portion 14 has a first end 34 and a second end 36 and the pair of feet portions 26, 28. The pair of feet portions 26, 28, have a groove 30, 32 thereon disposed in close proximity to the first end 34 and to the second end 36 preferably, near the midpoint of the bight portion 14. The pair of feet portions 26, 28, are resiliently separable and normally spring biased toward each other, in a normally closed position, to engage the shank 54 of the button 52 shown in FIG. 8.

Figure 5:
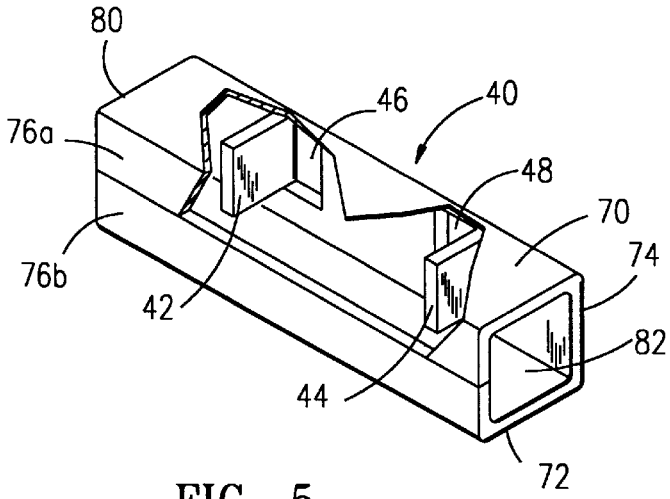
FIG. 5 is a partial sectional perspective view of the encasement of FIG. 1 showing an elongated shape having a square cross section, side passageways, stop walls and apertures and the encasement being formed from the C-shaped member of FIG. 4 by crimping at assembly.
Figure 6:
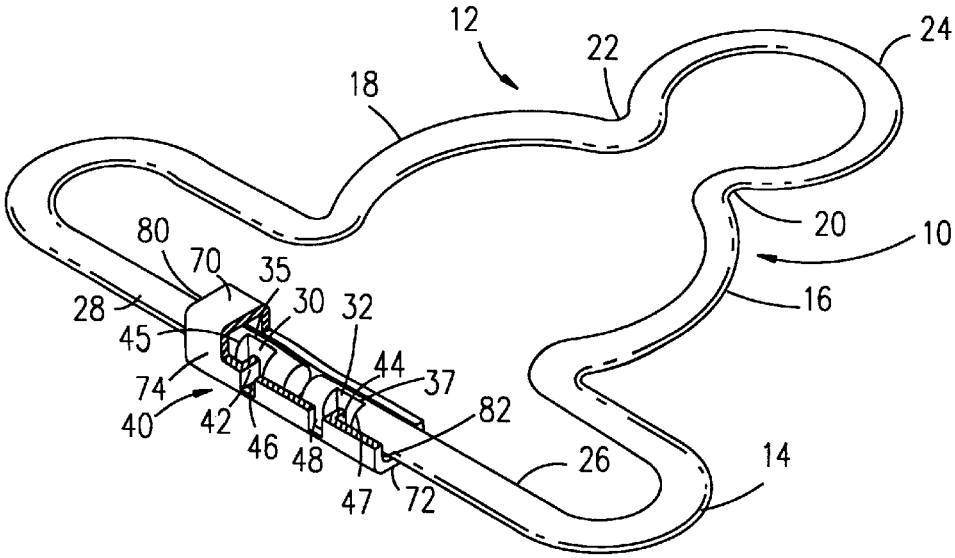
FIG. 6 is a partial sectional perspective view of the buckle clip of FIG. 1 showing the encasement assembled to the loop.

As shown in FIG. 5 and in FIG. 6, the stop walls 42, 44 in the encasement 40 cooperate with the groove 30, 32 of the pair of feet portions 26, 28 of the loop 12 shown in FIG. 2, for limiting the resilient lateral movement of the pair of feet portions 26, 28 to prevent over extension of the loop 12. The pair of feet portions 26, 28 have a first pair of contact surfaces 35, 37 and a second pair of contact surfaces 45, 47 as shown in FIG. 2 and in FIG. 6 for engaging the stop walls 42, 44.

Figure 3:
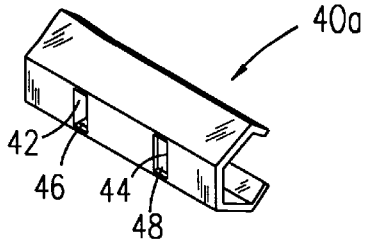
FIG. 3 is a perspective view of a preferred embodiment the buckle clip of FIG. 1 showing a C-shaped member initially developed from a planar material for later being formable into an encasement shown in FIG. 5 when the C-shaped member is attached to the bight portion of the loop at assembly as shown in FIG. 1.
Figure 4:
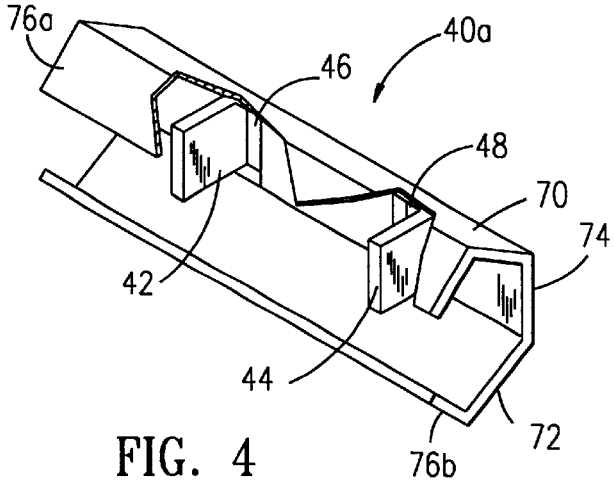
FIG. 4 is a partial sectional perspective view of the C-shaped member of FIG. 3 showing stop walls and apertures.

The encasement 40, preferably is formed from a C-shaped member 40*a* shown in FIG. 3 and in FIG. 4. The C-shaped member 40*a* may be initially developed from an elongated substantially planar sheet of rigid material. Preferably, the C-shaped member may be formed from metals such as, but not limited to, brass, steel and aluminum by metal stamping in progressive operations and, although not necessary for operation, may have an electro plate finish to suit particular consumer applications.

The C-shaped member 40*a*,shown in FIG. 4 has a top wall 70, a bottom wall 72, a front wall 74 and two wall portions, an upper wall 76*a* and a lower wall 76*b*,which are later joined in an abutting relationship, at assembly, by crimping to form the encasement 40 shown in FIG. 5. The C-shaped member 40*a*, has the pair of stop walls 42, 44 integrally formed on the front wall 74 by punching and by inwardly bending a part of the front wall 74 thereby resulting in the creation of a pair of apertures 46, 48.

FIG. 5 is a partial sectional perspective view of the encasement 40 of FIG. 1 after being formed from the C-shaped member 40*a*. The encasement 40 preferably, has an elongated shape having a square cross section, side passageways 80, 82, stop walls 42, 44 and apertures 46, 48. The upper wall 76*a* and the lower wall 76*b* are joined in an abutting relationship to form a back wall which creates an enveloping enclosure.

FIG. 6 is a partial sectional perspective view of the buckle clip of FIG. 1 showing the encasement 40 assembled to the loop 12 as previously described.

Figure 7:
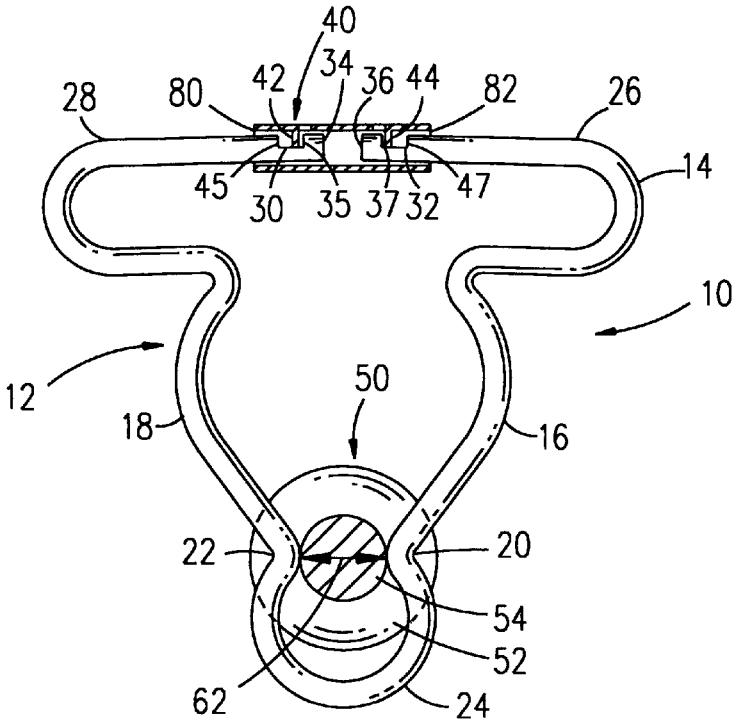
FIG. 7 is a partial cross sectional view of a preferred embodiment of the buckle clip of FIG. 1, in use, according to the teaching of this invention, showing the loop when the shank of a fastener such as a button is positioned in the neck portion of the loop thereby causing the ends of the bight portion of the loop to be urged away from each other in an open position and spreading the loop apart a sufficient amount to accommodate the shank of the button; and, FIG. 8 is a partial cross sectional view of a preferred embodiment of the buckle clip of FIG. 1, in use, according to the teaching of this invention, showing the loop disposed in a normally closed position with the ends of the bight portion of the loop being spring biased toward each other, when the fastener such as the button having the shank is placed between the arms of the loop and is pushed such that the button and the shank are resting in the open portion.
Figure 8:
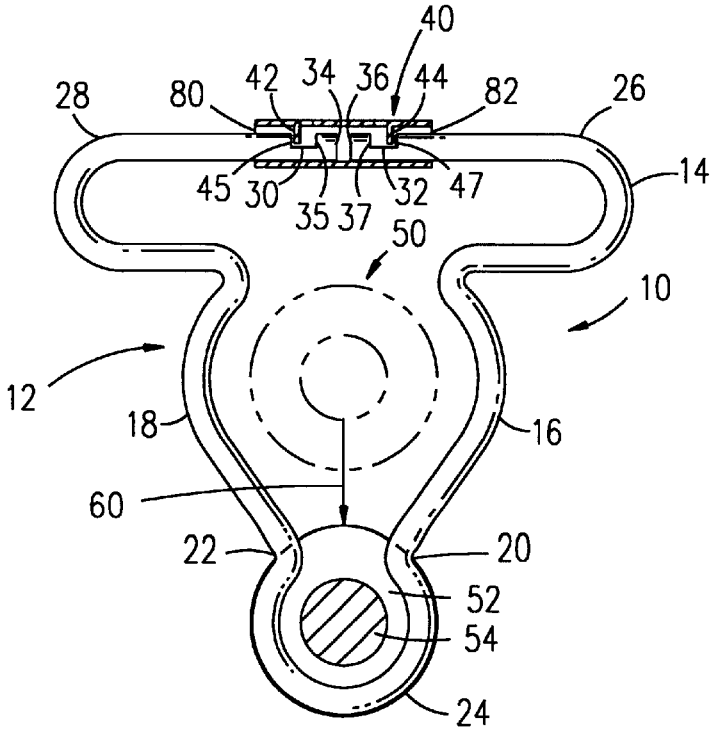

Operation of the buckle clip 10, is best understood by turning to FIG. 7 and to FIG. 8.

FIG. 7 is a partial cross sectional view of a preferred embodiment of the buckle clip 10 of FIG. 1, in use, according to the teaching of this invention, showing the loop 12 with the shank 54 of the button 52 positioned in the neck portion 20, 22 of the loop 12, through which the fastener 50 passes enroute to being received and being removably retained in the open portion 24 as indicated in FIG. 8. The neck portion 20, 22 spreads apart when contacted by the shank 54 of the button 52 as indicated by arrows 62. This causes the first end 34 and the second end 36 of the bight portion 14 of the loop 12 to be urged away from each other in an open position and spreads the loop 12 apart a sufficient amount to accommodate the shank 54 of the button 52. This allows passage of the shank 54 of the button 52 therethrough and then returning to the normal spring biased decompressed state, thereby preventing the button 52 from becoming disengaged unwantedly as shown in FIG. 8. A portion of the pair of feet portions 26, 28 extend restrictively through the pair of side passageways 80, 82 in the encasement 40 such that the first end 34 and the second end 36 of the bight portion 14 cooperates with the pair of stop walls 42, 44 and with the groove 30, 32. The first pair of contact surfaces 35, 37 of the pair of feet portions 26, 28 engage the pair of stop walls 42, 44 in the open position. The encasement is dimensioned to allow sufficient resilient lateral movement of the resilient wire loop 12 to prevent over extension of the loop 12 for receiving and for engaging the shank 54 of the button 52, for removably retaining the button 52 and for translating the resilient lateral movement of the open portion 24 to the pair of feet portions 26, 28 of the bight portion 14.

FIG. 8 is a partial cross sectional view of a preferred embodiment of the buckle clip 10 of FIG. 1, in use, according to the teaching of this invention, showing the loop 12 disposed in a normally closed position. The first end 34 and the second end 36 of the bight portion 14 of the loop 12 being spring biased toward each other, when the fastener 50 such as the button 52 with the shank 54 is placed between the pair of arms 16, 18 of the loop 12 and is pushed downward as indicated by arrow 60, and passing through the neck portion 20, 22 such that the button 52 and the shank 54 are received and are removably retained in the open portion 24. The spring biasing action prevents the button 52 from becoming disengaged unwantedly. When disengagement of the button 52 is desired, it can be readily accomplished by reversing the previously mentioned operation. A portion of the pair of feet portions 26, 28 extend restrictively through the pair of side passageways 80, 82 in the encasement 40 such that the first end 34 and the second end 36 of the bight portion 14 cooperates with the pair of stop walls 42, 44 and with the groove 30, 32. The second pair of contact surfaces 45, 47 of the pair of feet portions 26, 28 engage the pair of stop walls 42, 44 in the normally closed position.

Preferably, the buckle clip 10 may be made fabricated from metal by conventional metal fabrication techniques such as by metal forming and by metal stamping. The buckle clip 10 may be made from brass, steel, aluminum or other metals. Although electroplating is not necessary for operation, the buckle clip 10 may be selectively electroplated in a variety of finishes to suit particular consumer applications. Alternately, the buckle clip 10 may also be adapted for manufacture of the loop 12 and for the encasement 40 to be made from nonmetal materials such as plastic or combinations of metal and plastic, as required. The buckle clip 10 may be constructed in a wide variety of sizes and style variations for use with garments such as suspenders, overall straps, jeans and for any application where a supporting strap or band is necessary. For example, the buckle clip 10 may find use for camera cases, binocular cases, gadget bags, luggage, undergarments, hosiery, waders, boots and for any other suitable structure in need of support where the buckle clip 10 can be attached thereto, without departing from the scope of this disclosure.

One practical advantage of the invention is that it provides an efficient, convenient, practical, low cost and versatile buckle clip 10 where the encasement 40 completely encloses and envelopes the pair of feet portions 26, 28 and, during use, reduces the possibility of damaging, by fraying or tearing of a garment or supporting member or premature unwanted disengagement of the fastener 50. The encasement 40 also retains the pair of feet portions 26, 28 of the loop 12 in alignment and restricts their resilient lateral movement by preventing the arms 16, 18 from being overly extended which eliminates the risk of deforming them such that they lose their resilient spring action and consequently fail to cooperatively function to positively retain the fastener 50 as desired.

Another advantage of the invention is that the buckle clip 10 is designed for ease of manufacture with efficient material use as well as for functionality, particularly with the construction of the stop walls 42, 44 which are integral with the front wall 74 of the encasement 40 resulting in no material waste.

A further advantage of the invention is that the buckle clip 10 is designed to facilitate manufacture, by using the initially developed C-shaped member 40*a* from which the encasement 40 is finally formed by crimping during assembly.

The instant invention provides an attractive, highly functional buckle clip 10 that securely and positively engages and disengages the fastener 50 having the shank 54 of the button 52 when in use. Of course, a wide variety of further uses and advantages of the present invention will become apparent to one skilled in the art.

As disclosed, it is apparent that the instant invention can provide other resilient fastening and suspension options for use on various garments or structures and wherever a button type projection such as a shank is provided. One skilled in the art will realize that the foregoing discussion outlines the more important features of the invention to enable a better understanding of the instant invention and to instill a better appreciation of the inventor's contribution to the art. It must be clear that the disclosed details of construction, descriptions of geometry and illustrations of inventive concepts are mere examples of possible manifestations of the invention.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A buckle clip comprising:

a loop;

said loop, continuously formed from a resilient wire, having a bight portion for suspension from a strap, a pair of arms for receiving a fastener such as a button having a shank and an open portion for receiving and for removably retaining the button;

said bight portion having a first end and a second end and a pair of feet portions;

said pair of feet portions having a groove thereon disposed in close proximity to said first end and to said second end of said bight portion near the midpoint of said bight portion;

said pair of feet portions having a first pair of contact surfaces and a second pair of contact surfaces;

said pair of feet portions of said bight portion being resiliently separable and normally spring biased toward each other to engage the shank of the button;

an encasement;

said encasement slideably attachable to said bight portion of said loop and said encasement completely enveloping said first end and said second end of said pair of feet portions;

said encasement having side passageways through which a part of said pair of feet portions extend as they separate when said pair of feet portions resiliently move laterally;

said encasement having a pair of stop walls integrally formed thereon and, said stop walls cooperating with the groove and with said first pair of contact surfaces and said second pair of contact surfaces of said pair of feet portions for limiting the resilient lateral movement of said pair of feet portions to prevent over extension of said loop.

2. The buckle clip of claim 1 wherein said pair of stop walls are integrally formed within a front wall of said encasement by punching and by inwardly bending a part of said front wall such that said pair of stop walls are disposed interiorly of said encasement.

3. The buckle clip of claim 2 wherein said encasement being dimensioned to allow sufficient resilient lateral movement of said resilient wire loop for receiving and for engaging the shank of the button, for removably retaining the button and for translating the resilient lateral movement of said open portion to said pair of feet portions of said bight portion.

4. The buckle clip of claim 3 wherein said encasement is of a one piece construction.

5. The buckle clip of claim 4 wherein said encasement being developed from a C-shaped member having a top wall, a bottom wall, a front wall and two wall portions, an upper wall and a lower wall and being formed from an elongated substantially planar sheet of rigid material.

6. The buckle clip of claim 5 wherein said C-shaped member is transformed into said encasement at assembly, by aligning said stop walls of said C-shaped member with the groove of said pair of feet portions of said bight portion of said loop and by crimping said C-shaped member onto said bight portion of said loop such that a back wall being defined in said encasement when said upper wall and said lower wall portions of said C-shaped member are joined in an abutting relationship.

7. The buckle clip of claim 6 wherein said encasement is centrally disposed on said bight portion.

8. The buckle clip of claim 7 wherein said encasement is an elongated enveloping shape having a square cross section.

9. The buckle clip of claim 8 wherein said encasement is fabricated by stamping.

10. The buckle clip of claim 9 wherein said encasement is metal.

11. The buckle clip of claim 10 wherein said loop is formed from a single piece of resilient wire.

12. The buckle clip of claim 11 wherein said buckle clip is fabricated from a metal selected from the group consisting of brass, steel and aluminum.

13. The buckle clip of claim 12 wherein said buckle clip has an electro plate finish.

14. A buckle clip comprising:

a loop;

said loop, continuously formed from a single piece of resilient wire, having a bight portion for suspension from a strap, a pair of arms for receiving a fastener such as a button having a shank and an open portion for receiving and for removably retaining the button;

said bight portion having a first end and a second end and a pair of feet portions;

said pair of feet portions having a groove thereon disposed in close proximity to said first end and to said second end of said bight portion near the midpoint of said bight portion;

said pair of feet portions having a first pair of contact surfaces and a second pair of contact surfaces;

said pair of feet portions of said bight portion being resiliently separable and normally spring biased toward each other to engage the shank of the button;

an encasement;

said encasement is of a one piece construction in the form of an elongated enveloping shape having a square cross section;

said encasement being dimensioned to allow sufficient resilient lateral movement of said resilient wire loop for receiving and for engaging the shank of the button, for removably retaining the button and for translating the resilient lateral movement of said open portion to said pair of feet portions of said bight portion;

said encasement slideably attachable to said bight portion of said loop and said encasement completely enveloping said first end and said second end of said pair of feet portions;

said encasement is centrally disposed on said bight portion;

said encasement having side passageways through which a part of said pair of feet portions extend as they separate when said pair of feet portions resiliently move laterally;

said encasement having a pair of stop walls integrally formed within a front wall of said encasement by punching and by inwardly bending a part of said front wall such that said pair of stop walls are disposed interiorly of said encasement and, said stop walls cooperating with the groove and with said first pair of contact surfaces and said second pair of contact surfaces of said pair of feet portions for limiting the resilient lateral movement of said pair of feet portions to prevent over extension of said loop.

15. The buckle clip of claim 14 wherein said encasement being developed from a C-shaped member having a top wall, a bottom wall, a front wall and two wall portions, an upper wall and a lower wall and being formed by stamping from an elongated substantially planar sheet of rigid material.

16. The buckle clip of claim 15 wherein said C-shaped member is transformed into said encasement at assembly, by aligning said stop walls of said C-shaped member with the groove of said pair of feet portions of said bight portion of said loop and by crimping said C-shaped member onto said bight portion of said loop such that a back wall being defined in said encasement when said upper wall and said lower wall portions of said C-shaped member are joined in an abutting relationship.

17. The buckle clip of claim 16 wherein said encasement is metal.

18. The buckle clip of claim 17 wherein said buckle clip is fabricated from a metal selected from the group consisting of brass, steel and aluminum.

19. The buckle clip of claim 18 wherein said buckle clip has an electro plate finish.

20. A method for manufacturing a buckle clip comprising the steps of:

providing a resilient wire;

continuously forming a loop, from said resilient wire, said loop having a bight portion with a first end and a second end and a pair of feet portions for suspension from a strap, a pair of arms for receiving a fastener such as a button having a shank and an open portion for receiving and for removably retaining the button;

creating a groove thereon said feet portions disposed in close proximity to said first end and to said second end of said bight portion near the midpoint of said bight portion resulting in the creation of a first pair of contact surfaces and a second pair of contact surfaces;

providing an elongated substantially planar sheet of rigid material;

developing a C-shaped member having a pair of stop walls integrally thereon, a top wall, a bottom wall, a front wall and two wall portions, an upper wall and a lower wall from said elongated substantially planar sheet of rigid material;

slideably attaching said C-shaped member to said bight portion of said loop by aligning said pair of stop walls of said C-shaped member with the groove of said pair of feet portions of said bight portion of said loop; and, forming an encasement having a back wall being defined when said upper wall and said lower wall portions of said C-shaped member are joined in an abutting relationship by crimping said C-shaped member to said bight portion of said loop such that said encasement completely envelopes a part of said bight portion and said encasement having side passageways through which a part of said pair of feet portions of said bight portion extend as they separate during resilient lateral motion such that the lateral motion is limited by said stop walls to prevent over extension of said loop.

* * * * *